US006355366B1

(12) United States Patent
Santini

(10) Patent No.: US 6,355,366 B1
(45) Date of Patent: Mar. 12, 2002

(54) PROCESS FOR COATING A WORKPIECE WITH A LUBRICANT

(75) Inventor: Marco Santini, VS-Villingen (DE)

(73) Assignee: Duralloy AG, Harkingen (CH)

( * ) Notice: Subject to any disclaimer, the term of this patent is extended or adjusted under 35 U.S.C. 154(b) by 0 days.

(21) Appl. No.: 09/596,151

(22) Filed: Jun. 16, 2000

(30) Foreign Application Priority Data

Jun. 24, 1999 (DE) ..... 199 29 090

(51) Int. Cl.[7] ..... B32B 9/00; B32B 19/00; C23C 28/00; C25D 5/34

(52) U.S. Cl. ..... 428/698; 205/194; 205/205; 428/699

(58) Field of Search ..... 205/205, 191, 205/194; 428/698, 699

(56) References Cited

U.S. PATENT DOCUMENTS 4,465,737 A * 8/1984 Miyatuka et al. ..... 428/339
5,203,224 A * 4/1993 Honda ..... 74/468

FOREIGN PATENT DOCUMENTS

JP 5-125625 A * 5/1993
JP 6-137432 A * 5/1994

* cited by examiner

*Primary Examiner*—Edna Wong
(74) *Attorney, Agent, or Firm*—Akin, Gump, Strauss, Hauer & Feld, L.L.P.

(57) ABSTRACT

A process is provided for coating a workpiece with a lubricant based on molybdenum disulfide. In the process the workpiece is exposed to a galvanic chromium plating bath prior to coating, so that a hard chromium plating with a hardness of at least 600 HV forms with a beaded or columnar structured surface. This structured surface is then filled and smoothed by the lubricant based on molybdenum disulfide.

14 Claims, 1 Drawing Sheet

PROCESS FOR COATING A WORKPIECE WITH A LUBRICANT

BACKGROUND OF THE INVENTION

The invention relates to a process for coating a workpiece with a lubricant based on molybdenum sulfide.

Molybdenum disulfide ($MoS_2$) is a substance similar to graphite which, because of its excellent sliding properties, finds application as a dry lubricant and in composite lubricants. For the most part, molybdenum disulfide is applied in liquid form in a solvent mixture. The layer thickness which remains after drying lies in a range of about $5\mu$ to $15\mu$ for a tribological requirement. This is suitable for high pressure and temperature requirements and is used especially for improvement of run-in.

It is also known to modify the molybdenum disulfide coating into a combined layer system. Layer systems of this type have been made for TiN and $Al_2O_3$: see Bae, Y. W. et al., "Synthesis and Friction Behavior of Chemically Vapor Deposited Composite Coatings Containing Discrete TiN and $MoS_2$ Phases," *J. of the American Ceramic Society*, 79(4):819–824(1996) and Srivatav, A. et al., "The Role of $MoS_2$ in Hard Overlay Coatings of $Al_2O_3$ in Dry Sliding," *Wear*, 1955:229–236 (1992).

SUMMARY OF THE INVENTION

With the present invention, a long-term usage of lubricants based on molybdenum disulfide is intended. In particular, the adhesion of the lubricant to the workpiece should be decidedly improved, so that the sliding surface formed by molybdenum disulfide has a considerably longer lifetime than before. In this connection, the already known positive properties of this lubricant should remain apparent to the full extent.

This objective is achieved according to the invention in that the workpiece is cleaned and activated, in a manner known per se, prior to coating with molybdenum disulfide, and in that it is then exposed to a galvanic chromium plating bath to form a hard chromium plating having a hardness of at least 600 HV with a beaded (pearl-like) or columnar structured surface, and in that this beaded or columnar structured surface is filled and smoothed by the subsequently applied lubricant based on molybdenum disulfide.

It has been surprisingly revealed that the beaded or columnar structured surface of the hard chromium underlayer exerts an exceptionally high adhesive action on the molybdenum disulfide. In addition to this, to the extent that it extends above the lower hard chromium layer, the molybdenum disulfide is compressed in practical operation within a short time, depending on the use and loading, in a sort of run-in operation, such that the upper ends of the bead or column structure are more or less exposed and function as highly loadable support surfaces for the opposing piece that is to be supported. In contrast, the intermediate spaces, which comprise at least 80% of the contacting surface, are filled with molybdenum disulfide, which results in a lasting reduction of the frictional resistance.

Workpieces coated in this manner have, in tests without additional lubricants, produced a service life up to seventy times greater than workpieces with $MoS_2$ on a smooth hardened surface.

The production of the hard chromium plating with a beaded or columnar structured surface is expediently accomplished according to German Patent 25 02 284. There, a chromium bath is described, with which shiny to metal-gray chromium platings can be obtained with a beaded structured surface having a hardness up to about 1500 HV. These chromium platings with the brand name "Duralloy" distinguish themselves by a high wear resistance.

Indeed, from DE 195 29 843 of the same applicant, it is known to coat this hard chromium plating by galvanically applied black chromium, whereby likewise very good sliding properties result. However, one could not generate any excitement from this black chromium coating, instead of providing a non-galvanic coating made of molybdenum sulfide.

In reference to the coating according to the invention with molybdenum disulfide, a galvanic deposition is not suitable. Instead, it is recommended to mix the lubricant with a carrier liquid and to apply it as a liquid, for example, to brush or spray it on. The molybdenum disulfide can thus be present in an air-drying solvent, wherein this solvent contains in particular, esters, butyl acetate, and optionally an inorganic bonding agent. Examples of suitable liquid carrier systems containing $MoS_2$ are known per se and are available commercially, for example from Dow Corning USA under designation nos. DC 7409 and DC 3484. When used on a normal, flat surface, such liquids are rubbed off quickly by normal wear, but on the beaded, pearl-like surface structure of the present invention, the lubricant liquid adheres and remains much longer.

The lubricant should be applied in the process at such a thickness that the remaining molybdenum disulfide after the drying reaches a layer thickness of $5\mu$ to $15\mu$.

In order to obtain a good adhesion, it is recommended that the lubricant be applied in gaseous form by vacuum-evaporation or using sputtering technology or gas discharge technology. Besides the so-called physical vapor deposition process (PVD-process), a chemical gas phase deposition (CVD process) also comes into consideration. With these processes either pure molybdenum disulfide is coated or—which is even more expedient—the molybdenum disulfide coating is accomplished together with titanium, wherein the titanium portion amounts at maximum to about 10%. Likewise, the molybdenum disulfide can also be applied together with chromium, nickel, and/or gold.

Also lying within the concept of the invention is to perform the coating by the so-called arc technology: in this process, molybdenum disulfide and other ions are flung out of a source by an electric arc, so that they deposit themselves on the workpiece to be coated.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings:

The invention is described in more detail in the following on the basis of an embodiment with drawings; shown therein FIG. 1 a cross-section through the workpiece after the application of the hard chromium and the black chromium layer and FIG. 2 the same cross-section after the run-in of the workpiece.

DETAILED DESCRIPTION OF THE INVENTION

The present invention is applicable to ferrous or non-ferrous heavy metals, but its principal application is to hardened chromium-nickel steel. To start with, a metal workpiece is used which is first thermally, at a maximum of 70° C., and electrolytically degreased, and then converted by a 5% sulfuric acid mordant from a basic to an acidic state, in order to activate it for the subsequent galvanic treatment. Then, the workpiece is immersed in a chromium plating bath, which contains 400 to 500 g/l chromium trioxide, 2 to 4 g/l strontium sulfate, 4 to 26 g/l potassium silicofluoride, 2 to 8 g/l potassium dichromate, and 4 to 50 g/l technical 2,2-dichloromalonic acid. In regard to the remaining treatment parameters, reference is made to the above-mentioned German Patent 25 02 284.

Figure 1:
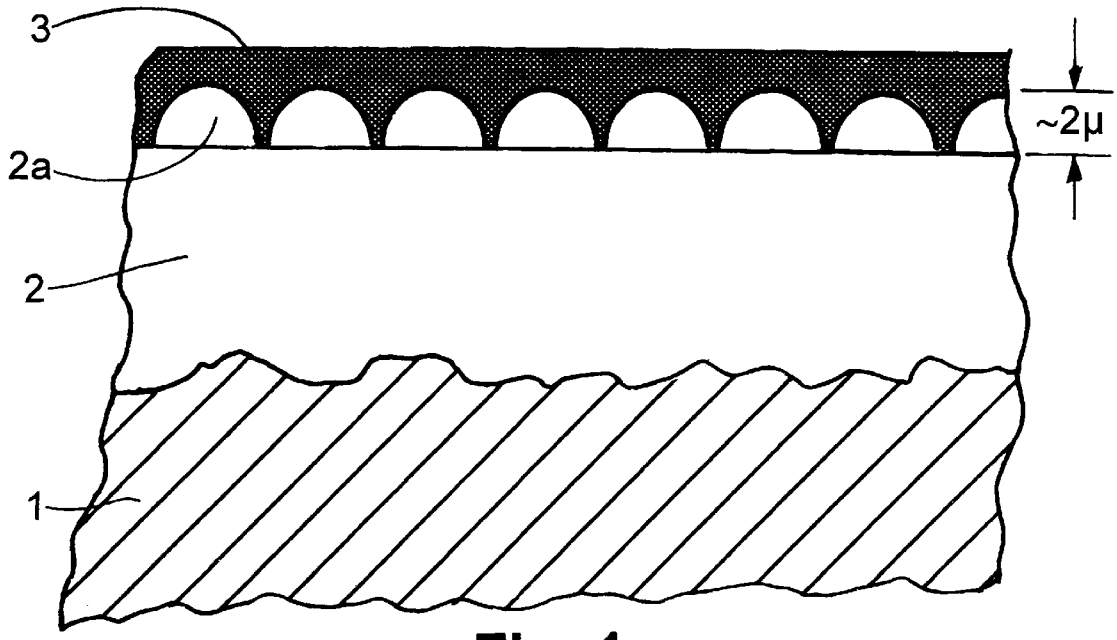

The workpiece 1 (see FIGS. 1 and 2) thus contains a hard chromium plating 2 with a layer thickness of at least $2\mu$, preferably about 4–$6\mu$ or more. The bath parameters are adjusted so that on the surface of the hard chromium layer, a more or less regular bead structure 2*a* appears with a roughness depth of at least about $1\mu$, preferably about $1.5\mu$ to about $5\mu$.

After this treatment, the workpiece is rinsed, in order to remove the residues of the chromium bath.

Then, molybdenum disulfide, which is present in liquid form in a solvent mixture with an inorganic bonding agent, is applied by brushing or spraying onto the bead structure 2*a*. In the example shown, 100Cr6 steel was coated with Dow Corning liquid DC 3484. The application should be done in such a quantity that the bead structure 2*a* of the hard chromium layer is at least filled and leveled, expediently also contains a certain covering, as is the case with the molybdenum disulfide coating 3 shown in FIG. 1.

The curing of the coating 3 is accomplished in about 30 minutes at room temperature.

Alternatively, the molybdenum disulfide can also be applied by atomizing in a vacuum onto the bead structure.

Figure 2:
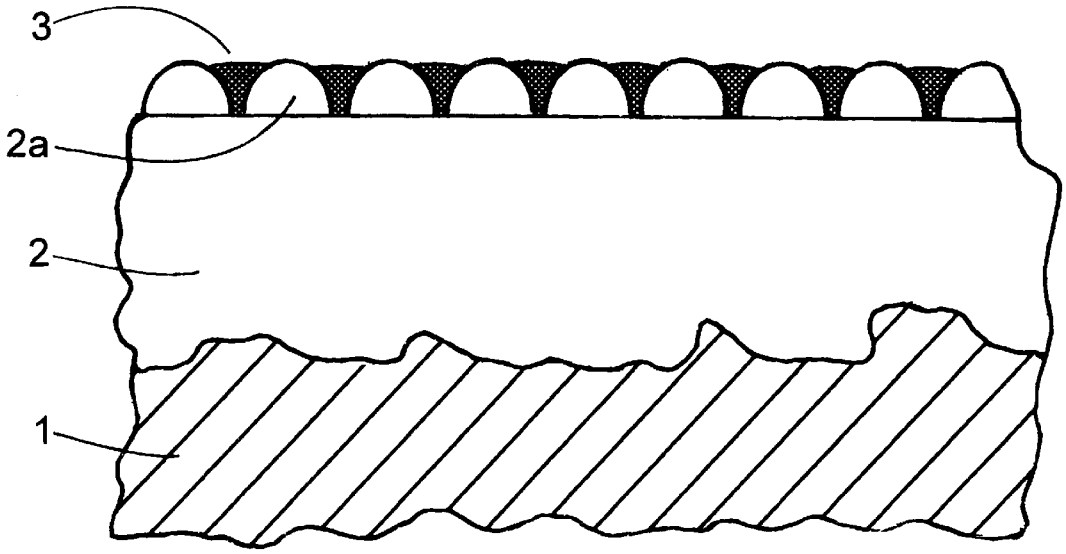

FIG. 2 shows the end state of the two-layer system according to the invention, as it appears after a short run-in phase. Here, the aforementioned covering of the molybdenum disulfide coating was leveled and compacted into the bead structure to such an extent that it runs approximately flush with the upper ends of the bead structure 2*a*. One thus obtains a continuous molybdenum disulfide phase, which is penetrated by a plurality of hard chromium islands. It has no pores or fissures whatsoever and is thus also corrosion-resistant to a high degree.

Workpieces coated according to the invention are suitable for all sliding and roller bearings, also spindles or the like, which depend on low friction with a long service life.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A process for coating a workpiece (1) with a lubricant (3) based on molybdenum disulfide, comprising first cleaning and activating the workpiece (1) prior to coating, then exposing the cleaned and activated workpiece to a galvanic chromium plating bath to form a plating (2) of hard chromium having a hardness of at least 600 HV with a beaded or columnar structured surface (2*a*), filling and smoothing the beaded or columnar structured surface by subsequently applying a lubricant (3) based on molybdenum disulfide, and exposing upper ends of the beaded or columnar structured surface (2*a*) such that the upper ends function as a carrier structure for an opposing piece to be supported.

2. The process according to claim 1, wherein the upper ends of the beaded or columnar structured surface (2*a*) comprise at maximum 20% of an effective planar surface of the workpiece.

3. The process according to claim 1, wherein the lubricant (3) is compacted during application or thereafter into recesses of the beaded or columnar structure (2*a*).

4. The process according to claim 1, wherein the lubricant (3) is mixed with a carrier liquid and applied as a liquid.

5. The process according to claim 4, wherein the molybdenum disulfide is prepared in an air-drying carrier liquid.

6. The process according to claim 4, wherein the carrier liquid contains ester, butyl acetate and optionally an inorganic bonding agent.

7. The process according to claim 4, wherein the liquid is brushed or sprayed on.

8. The process according to claim 1, wherein the lubricant (3) is applied in a layer thickness of about $5\mu$ to about $15\mu$.

9. The process according to claim 1, wherein the lubricant (3) is vacuum-evaporated in a gaseous state or using sputtering technology or gas discharge technology.

10. The process according to claim 1, wherein the lubricant (3) is present as substantially pure molybdenum disulfide.

11. The process according to claim 1, wherein the lubricant (3) comprises a mixture of molybdenum disulfide with at least one other metal.

12. The process according to claim 11, wherein the at least one other metal is the group consisting of titanium, chromium, nickel, and gold.

13. The process according to claim 1, wherein the upper ends of the beaded or columnar structured surface (2*a*) comprise less than 12% of an effective planar surface of the workpiece.

14. A workpiece coated according to the process of claim 1.

* * * * *